US005483222A

United States Patent [19]

Tice

[11] Patent Number: 5,483,222

[45] Date of Patent: Jan. 9, 1996

[54] MULTIPLE SENSOR APPARATUS AND METHOD

[75] Inventor: Lee D. Tice, Bartlett, Ill.

[73] Assignee: Pittway Corporation, Chicago, Ill.

[21] Appl. No.: 153,130

[22] Filed: Nov. 15, 1993

[51] Int. Cl.[6] ..... G08B 19/00

[52] U.S. Cl. ..... 340/518; 340/506; 340/511

[58] Field of Search ..... 340/505, 510, 340/511, 514, 518, 588, 589, 506

[56] References Cited

U.S. PATENT DOCUMENTS

| | | | |
|---|---|---|---|
| 4,388,616 | 6/1983 | Machida | 340/587 |
| 4,525,700 | 6/1985 | Kimura et al. | 340/518 |
| 4,556,873 | 12/1985 | Yamada et al. | 340/630 |
| 4,639,598 | 1/1987 | Kern et al. | 250/339 |
| 4,644,331 | 2/1987 | Matsuhita et al. | 340/587 |
| 4,668,939 | 5/1987 | Kimura et al. | 340/521 |
| 4,727,359 | 2/1988 | Yuchi et al. | 340/518 |
| 4,745,399 | 5/1988 | Kimura | 340/518 |
| 4,749,986 | 6/1988 | Otani et al. | 340/587 |
| 4,749,987 | 6/1988 | Ishii | 340/587 |
| 4,785,283 | 11/1988 | Yuchi | 340/501 |
| 4,796,205 | 1/1989 | Ishii et al. | 364/550 |
| 4,803,469 | 2/1989 | Matsushita | 340/577 |
| 4,818,994 | 4/1989 | Orth et al. | 340/870.21 |
| 4,831,361 | 5/1989 | Kimura | 340/506 |
| 4,871,999 | 10/1989 | Ishii et al. | 340/587 |
| 4,881,060 | 11/1989 | Keen et al. | 340/531 |
| 4,884,222 | 11/1989 | Nagashima et al. | 340/588 |
| 4,916,432 | 4/1990 | Tice et al. | 340/518 |
| 4,922,230 | 5/1990 | Ohtani et al. | 340/577 |
| 4,924,417 | 5/1990 | Yuasa | 364/550 |
| 4,972,178 | 11/1990 | Suzuki | 340/577 |
| 4,975,684 | 12/1990 | Guttinger et al. | 340/587 |
| 4,977,527 | 12/1990 | Shaw et al. | 364/571.03 |
| 5,005,003 | 4/1991 | Ryser et al. | 340/587 |
| 5,105,371 | 4/1992 | Shaw et al. | 364/550 |
| 5,138,562 | 8/1992 | Shaw et al. | 364/550 |
| 5,155,468 | 10/1992 | Stanley et al. | 340/501 |
| 5,168,262 | 12/1992 | Okayama | 340/523 |
| 5,281,951 | 1/1994 | Okayama | 340/514 |

FOREIGN PATENT DOCUMENTS

| | | |
|---|---|---|
| 59-157789 | 9/1984 | Japan . |
| 59-172093 | 9/1984 | Japan . |
| 61-98498 | 5/1986 | Japan . |

*Primary Examiner*—John K. Peng
*Assistant Examiner*—Daniel J. Wu
*Attorney, Agent, or Firm*—Dressler, Goldsmith, Shore & Milnamow, Ltd.

[57] ABSTRACT

An alarm system which incorporates a large number of ambient condition sensors makes a determination as to the existence of a predetermined alarm condition by detecting respective ambient conditions from each member of a group of sensors. The indicators from the plurality of sensors are each raised to a respective predetermined exponent and summed together. The resultant sum is compared to a predetermined threshold to determine whether or not the alarm condition is present. The detectors can be spaced apart from one another in a selected region and coupled to a central control unit by a bi-directional communications link. Running averages of sums can be formed to provide filtering or smoothing or trend analysis.

43 Claims, 3 Drawing Sheets

********INITIALIZE********

Power Up —— 100

Let the system stabilize

Measure analog value

Input the IAI (individual alarm increment) —— 102
(Typically 1200uS)

****SYSTEM RUNNING****

Measure POA (percentage of alarm for each device in the group) —— 106
If POA > 1, then POA = 1
If POA < 0, then POA = 0
raise POA to exponent b —— 110
Typical b = 2

SUM POA**b with all other sensors per group assigned (if any) —— 112

--Per group--
PRE-ALARM IF SUM > .25
LOCAL ALARM IF (ANY POA = 1) AND (SUM < = 1.25)
FULL SYSTEM ALARM IF (SUM > 1 AND ALL POA < 1) OR (SUM > 1.25)
} 114

FIG. 2

MULTIPLE SENSOR APPARATUS AND METHOD

FIELD OF THE INVENTION

The invention pertains to systems for determining the presence of a selected condition based on a plurality of data inputs. More particularly, the system pertains to a fire detection system which receives inputs from a large number of detectors or sensors which are spaced apart from one another in one or more regions of interest.

BACKGROUND OF THE INVENTION

Various systems are known for the detection of alarm conditions. One particular form of such a system is a smoke or fire detecting system for a type generally illustrated in previously issued Tice et al. U.S. Pat. No. 4,916,432.

Upon receipt of inputs from a plurality of sensors a control unit associated with this system is able to make a determination as to whether or not a fire condition is present in one or more regions of interest. A variety of techniques have in the past been used for purposes of making this determination.

One known technique has been to compare one or more of the outputs of one or more sensors to one or more preestablished thresholds. The use of multiple thresholds permits the evaluation of trend information from one or more detectors.

Detection systems are evolving and are able to support larger numbers of sensors, 600 to 800 sensors or more. In this environment, it becomes desirable and important to be able to analyze outputs from large numbers of detectors at a relatively high rate so as to provide timely information as to trends as well as actual alarm conditions.

It is also desirable to be able to assess potential alarm conditions without having to make a large number of measurements over a period of time with respect to some or all of the sensors. In addition, it would be desirable to be able to analyze and determine the presence or absence of an alarm condition from a large number of detectors without substantially increasing the cost of the associated control unit.

Thus there continues to be a need for methods and systems of analyzing data received from large numbers of detectors.

SUMMARY OF THE INVENTION

In accordance with the invention, a method of detecting a predetermined condition using a plurality of spaced apart ambient condition sensors includes the steps of:

sensing ambient conditions associated with at least some members of the plurality and producing an indicium of each sensed condition;

collecting the indicia at a common location;

forming a group of selected indicia;

processing the group, including raising each member of the group to an associated predetermined exponent and summing exponentially raised indicia to form a result; and using the result to detect the predetermined condition.

In another aspect of the invention, an apparatus usable with a large number of detectors or sensors to detect a predetermined condition based on measurements made at a plurality of detectors includes a control unit. A communications link is coupled to the control unit and extends therefrom.

A plurality of spaced apart sensors is coupled to the link. Each member of said plurality is capable of producing an indicium representative of an adjacent ambient condition. Each sensor is capable of communicating ambient condition indicating indicia to the control unit.

The control unit includes a storage element for storing at least some of the indicia. The control unit includes circuitry for raising at least some of the indicia to associated predetermined exponents and summing the exponentially raised indicia to form a result. The result is then compared to a predetermined value to determine if the condition is present.

In yet another aspect of the invention, the sums can be added together to form a running average. The trend exhibited by the average can be used to determine whether or not an alarm condition exists.

Alternately, sums can be formed for one or more groups of detectors or sensors. The sums formed over a period of time from each of the groups could be directly combined. Alternately, the slopes of the sums can be determined for each of the groups and used to determine the presence of a fire condition.

These and other aspects and attributes of the present invention will be discussed with reference to the following drawings and accompanying specification.

BRIEF DESCRIPTION OF THE DRAWING

FIG. 2 is a flow diagram illustrating a method which embodies the present invention.

DETAILED DESCRIPTION OF THE PREFERRED EMBODIMENT

Figure 1:
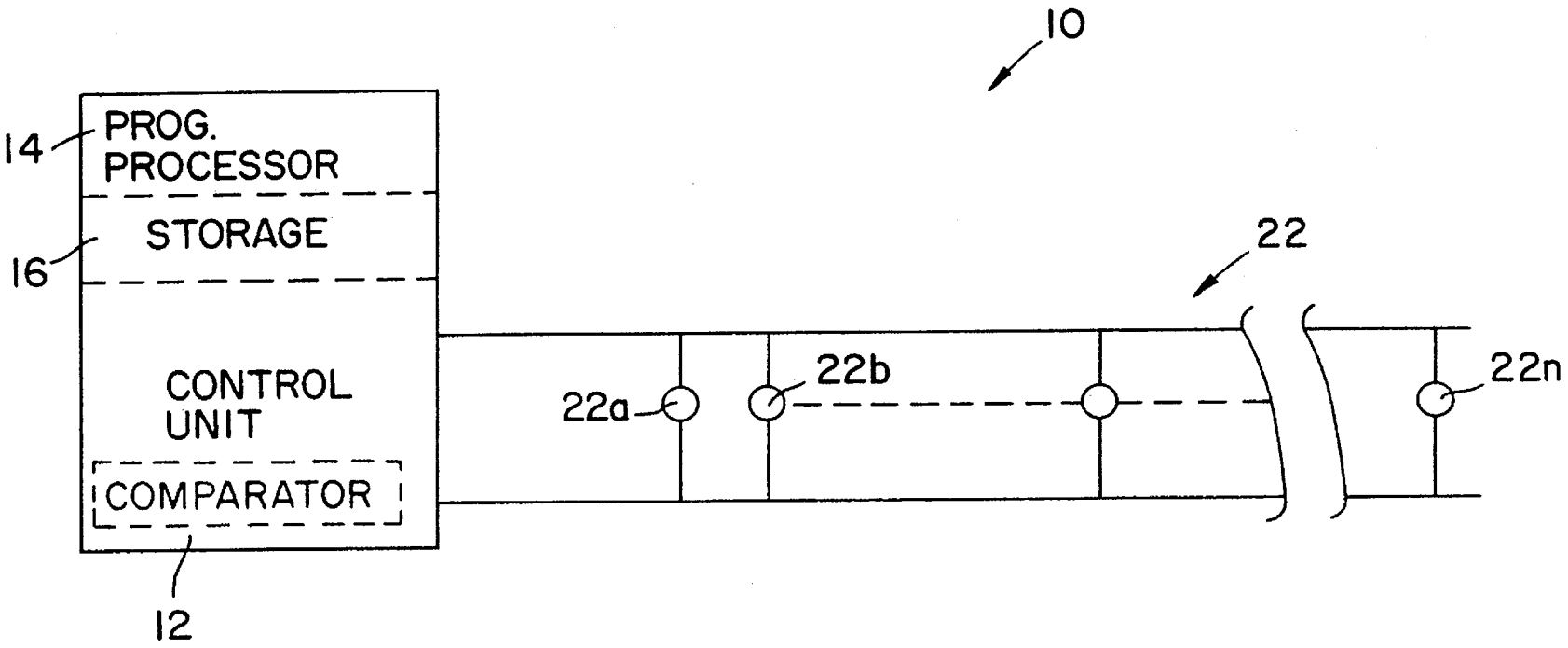
FIG. 1 is a block diagram of a system in accordance with the present invention.
Figure 3A:
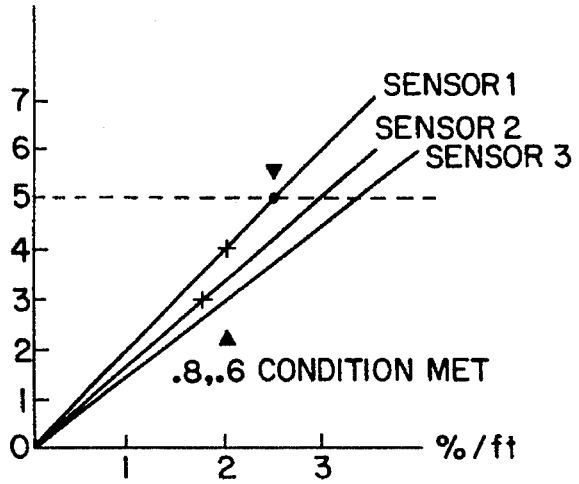
FIG. 3 illustrates performance characteristics of systems in accordance with the present invention for varying members of detectors.
Figure 3B:
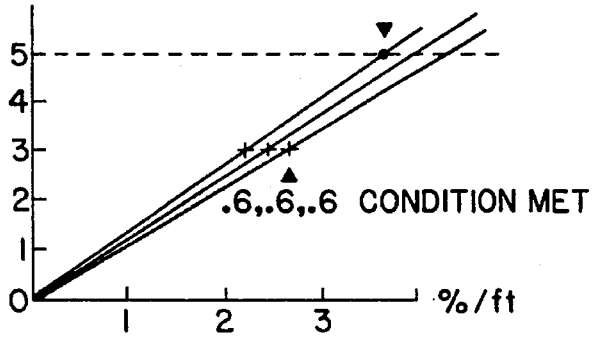
Figure 3C:
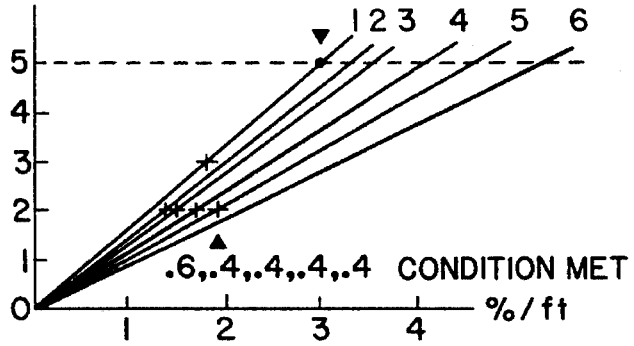
Figure 3D:
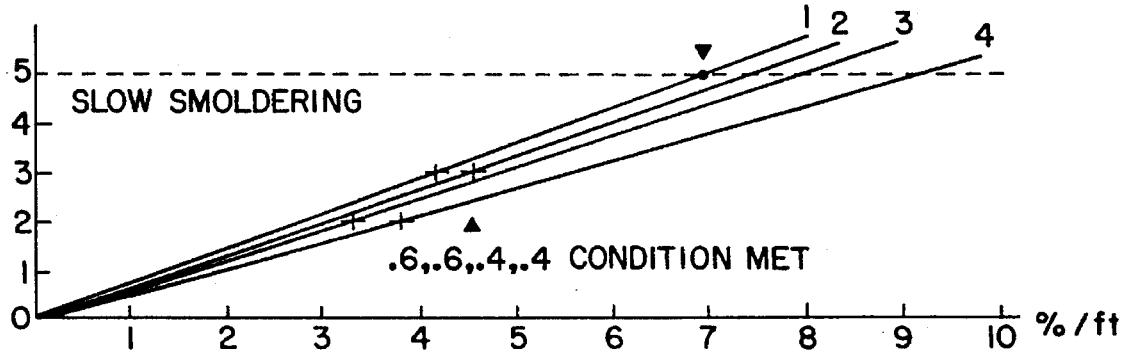

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates a block diagram of a system 10 in accordance with the present invention. The system 10 includes a control unit 12 which can be implemented with a programmable processor 14 and a storage unit 16. The storage unit 16 can include both control programs and data storage for use by the processor 14.

The control unit 12 is coupled by bi-directional communication lines 20 to a plurality of ambient condition sensors or detectors generally indicated at 22. The members of plurality 22, such as sensor **22*a*, 22*b*, up to 22*n*** are intended to detect a particular ambient condition in an adjacent region.

Representative-types of sensors include ionization-type or photoelectric-type smoke detectors. Temperature sensors as well as PIR-type detectors could also be used with a system in accordance with the present invention.

The members of the plurality 22 can be spaced apart on a floor of a building or can be spaced apart on a plurality of different floors if desired. For control and sensing purposes, as is well known, it may be desirable to define subgroups within the plurality 22 which have some particular association, such as a subgroup including all detectors on a particular floor of a building.

In accordance with the present apparatus and method, at a predetermined time, the detectors of the plurality 22, or a predefined subgroup thereof, are commanded by the control unit 12 to sense an adjacent ambient condition and generate a respective indicium therefor. The collective indicia from the members of the plurality 22, or the respective subgroup thereof, are then transferred to the control unit 12.

The indicia received at the control unit 12 are processed and each is raised to a respective, predetermined exponential value. The exponential values associated with respective detectors need not be the same.

The exponential values can for example, be integer values of 2 or more. It will be understood however, that the present apparatus and method are not limited to integer exponential values.

The values of indicia which have been raised to the predetermined exponential value are then summed to produce a result. Summing can include subtraction of various terms. For example, outputs from PIR units, indicating the presence of living people or animals in the respective region, can be used to reduce the sum.

The result can be compared in the control unit 12 to a predetermined value. Hence the system will indicate an alarm where:

$$D_1^{x1}+D_2^{x2}+D_3^{x3} \ldots +D_n^{xn}\pm D_{n+1}^{xn+1} \geqq \text{Threshold Value}$$

where $D_i$ is a value received from detector "i" and $x_i$ is an associated exponent.

If the sum exceeds the value, the control unit 12 can proceed on a basis that the predetermined condition has been sensed and is present in the region associated with either the plurality 22 or a respective subgroup thereof.

The sums, determined over a period of time, can be used to form a running average. Alternately, the slope or slopes can be calculated to make an alarm condition determination.

FIG. 2 illustrates of the steps of a method which embodies the present invention. In an initial step 100, power is applied to the system 10. Each of the sensors such as the sensor 22*a* can be initialized in a step 102.

Subsequently, a processing sequence is entered. In the processing sequence each subgroup of the defined plurality of sensors 22 can be treated separately. In a step 106, each of the members of a selected subgroup is directed by the control unit 12 to read or sense the respective ambient condition. The sensed values are then returned to the control unit 12.

In a step 110, the control unit 12 raises each of the returned values to a respective predetermined exponent. The exponential values can be different from one detector to another or from one detector type to another.

In a step 112, each of the exponentially increased values associated with the given subgroup is added together to form a result. In a step 114, the sum can be compared to one or more predetermined thresholds. If the sum exceeds the respective threshold, a respective alarm can be generated.

The process can then be repeated for another subgroup or the same subgroup for purposes of smoothing or averaging. It will be understood that the use of running averages or determination of slopes to make a fire determination comes within the spirit and scope of the present invention.

It will be understood that other pre-alarm, local alarm, and full system alarm levels are possible as well as a choice of different exponential values.

Many variations on the use of the multi-device method can give good system performance. For example, it is possible to lower the pre-alarm level for a small number of devices if it becomes a function of the number of devices in a group by the following equation:

PRE-ALARM if SUM>(0.1+0.15*(N−1)/N)*NF where NF (noise factor)=1 for normal systems and 2 for noisy systems. N=number of devices It will be understood that the type of sensor or detector of the plurality 22 is not a limitation of the present invention. For example, the system 10 can be a fire detection system and the members of the plurality 22 can be heat or fire detectors. Alternately, some or all of the members of the plurality 22 could be gas detectors.

In the following discussion, several examples are discussed in more detail for purposes of explaining the operation and features of the system 10 and not for purposes of limiting the claimed invention. It will be understood that the particular details of processing the sensed ambient condition values and raising same to predetermined exponential value are also not a limitation of the present invention.

In the present example, outputs from a group of sensors are received. The received values are assigned values of 0–1. Zero is clear air, 1 is the alarm level. The returned outputs are squared. The squared values are summed to form a result.

The sum of the squared values must exceed a threshold value before the system will alarm. The squaring function gives inherently higher weight to higher analog values from individual sensors.

Table 1 illustrates minimum values necessary to alarm the system for different numbers of sensors or detectors. The alarm threshold is 1 and the detectors base output values 0–1.

TABLE 1

| | SENSOR VALUES | | | | | SUM OF SQUARES |
|---|---|---|---|---|---|---|
| 1 SENSOR: | 1.0 | | | | | 1.00 |
| 2 SENSORS: | 1.0 | .4 | | | | 1.16 |
| | .8 | .6 | | | | 1.00 |
| 3 SENSORS: | 1.0 | .4 | | | | 1.16 |
| | .8 | .6 | | | | 1.00 |
| | .6 | .6 | .6 | | | 1.08 |
| 4 SENSORS: | 1.0 | .6 | | | | 1.16 |
| | .8 | .6 | | | | 1.00 |
| | .6 | .6 | .6 | | | 1.08 |
| | .6 | .6 | .6 | .6 | | 1.04 |
| 5 SENSORS: | 1.0 | .4 | | | | 1.16 |
| | .8 | .6 | | | | 1.00 |
| | .6 | .6 | .6 | | | 1.08 |
| | .6 | .6 | .6 | .6 | | 1.04 |
| | .6 | .4 | .4 | .4 | .4 | 1.00 |

To minimize false alarms, where there is more than 1 sensor, two sensors must have values of at least level 2 before the system will alarm. Otherwise, a pre-alarm can be given. Any one device can be above the alarm threshold and the system will only give a pre-alarm if all other devices in the group are below level 2.

Any value greater than 1 is clamped to 1 for the sum of squares method. A test condition may produce a received value of 1.40, for example, but would still be limited to 1.00.

The method operates on the principle that if many sensors are simultaneously increasing in value, then a fire is alarmed even though a single sensor has not reached its individual alarm threshold—as long as certain minimum conditions are met. This provides an important predictive characteristic.

For example, with 2 sensors an alarm will be generated if one detection is level 0.8 (80% of alarm) and another level 0.6 (60% of the alarm). But if 6 sensors are used in the group, then the alarm is determined if one sensor is level 0.6 (60%) and at least four other sensors are level 0.4 (40%) or greater.

Values can be returned from detectors as a percent of alarm value. By altering a preset alarm level a given detector or type of detector can be given a different weight since the returned percent values will also be altered for a given ambient condition.

The graphs of FIG. 3 illustrate some possibilities of system performance with the present method for various numbers of sensors.

From the foregoing, it will be observed that numerous variations and modifications may be effected without departing from the spirit and scope of the invention. It is to be understood that no limitations with respect to the specific apparatus illustrated herein is intended or should be inferred. It is, of course, intended to cover by the appended claims all such modifications as fall within the scope of the claims.

What is claimed is:

1. A method of detecting a predetermined condition using a plurality of spaced apart ambient condition detectors comprising:

providing a plurality of spaced apart ambient condition detectors;

providing a control unit;

providing a communications link between the detectors and the control unit;

sensing ambient conditions associated with at least some members of the plurality and producing an indicium of each sensed condition;

collecting the indicia at the control unit;

forming a group of selected indicia at the control unit;

processing the group at the control unit, including raising each member of the group to a predetermined, respective exponent and summing exponentially raised indicia to form a result; and comparing the result to two or more predetermined, different, threshold values to detect the presence of two or more predetermined conditions.

2. A method as in claim 1 wherein each member of the group is squared prior to the summing step.

3. A method as in claim 1 wherein the exponents each have an integer value of at least 2.

4. A method as in claim 1 wherein the ambient condition detectors detect products of combustion and the predetermined condition is an alarm condition indicating the presence of a fire.

5. A method as in claim 1 wherein the using step includes:

forming a plurality of sums during a predetermined time interval and then using the sums to detect the predetermined condition.

6. A method as in claim 5 wherein at least one average value is formed from the sums.

7. A method as in claim 1 wherein at least one of the exponentially raised indicia has a negative sign.

8. A method as in claim 1 wherein respective ambient conditions associated with some of the detectors are sensed at substantially the same time.

9. An apparatus usable to detect a predetermined condition comprising:

a control unit;

a communications link coupled to said control unit and extending therefrom;

a plurality of spaced apart detectors wherein each member of said plurality is capable of sensing an adjacent ambient condition and of producing an indicium representative thereof, each said member is coupled to said link and is capable of communicating ambient condition indicating indicia to said control unit and wherein said control unit includes a storage element for storing at least some of said indicia and circuitry for raising at least some of said indicia to predetermined, respective exponents and summing said exponentially raised indicia to form a result and wherein said control unit includes a comparator for comparing said result to two or more predetermined thresholds.

10. An apparatus as in claim 9 wherein said control unit squares at least some of said indicia prior to summing.

11. An apparatus as in claim 9 wherein said control unit raises at least some of said indicia to respective exponents which have integer values which exceed two.

12. An apparatus as in claim 9 wherein at least some of said detectors each include a combustion products sensor.

13. An apparatus as in claim 9 wherein said control unit includes a programmable processor.

14. An apparatus as in claim 9 wherein said communications link includes a pair of bi-directional communications lines.

15. An apparatus as in claim 9 wherein said control unit includes circuitry for commanding a plurality of said detectors to sense said respective ambient conditions at substantially the same time.

16. A method of detecting a fire condition using a plurality of spaced apart detectors comprising:

providing a plurality of spaced apart ambient condition detectors;

providing a control unit;

providing a communications link between the detectors and the control unit;

sensing at each detector an ambient condition and producing an indicium of each sensed condition;

collecting at least some of the indicia at the control unit by means of the communications link;

processing each indicium by squaring at the control unit;

summing the squared indicia to form a result at the control unit; and comparing the result to at least two different threshold values to detect the presence of two different fire conditions.

17. A method as in claim 16 wherein the detectors detect products of combustion and each detector produces an indicium thereof which can be sampled at a selected time.

18. A method as in claim 16 which includes forming a plurality of results over a period of time and using the plurality to detect the fire condition.

19. An apparatus for detecting a fire condition using a plurality of spaced apart detectors wherein each detector is capable of sensing an ambient condition at substantially the same time and producing an indicium of each sensed condition at that time, the apparatus comprising:

communications circuitry for collecting at least some of the indicia at a common location; and a control unit, coupled to said communications circuit for processing each indicium by squaring including circuitry for summing the squared indicia to form a result wherein said control unit includes a comparator circuit for comparing said result to at least two different thresholds.

20. An apparatus as in claim 19 wherein the detectors detect products of combustion and each detector produces an indicium thereof which can be sampled at a selected time.

21. A method of detecting a predetermined condition using a plurality of spaced apart ambient condition detectors comprising:

providing a plurality of spaced apart ambient condition detectors;

providing a control unit;

providing a communication link between the detectors and the control unit;

sensing ambient conditions associated with at least some members of the plurality and producing an electrical indicium of each sensed condition at the control unit;

forming a group of selected indicia at the control unit;

processing the group, including electrically raising each member of the group to a predetermined, respective exponent wherein some members of the group are raised to a first exponential value and other members of the group are raised to a second, different, exponential value and summing the exponentially raised indicia to form a result; and comparing the result to at least two different threshold values to detect the presence of two different fire conditions.

22. A method as in claim 21 wherein each member of the group is squared prior to the summing step.

23. A method as in claim 21 wherein the exponents have integer values equal to or greater than 2.

24. A method as in claim 21 wherein the using step includes electrically comparing the result to a predetermined threshold.

25. A method as in claim 21 wherein the using step includes:

forming a plurality of sums during a predetermined time interval and then using the sums to detect the predetermined condition.

26. A method as in claim 25 wherein one or more average values is formed from the sums.

27. A method as in claim 21 wherein one or more of the exponentially raised indicia has a negative sign.

28. A method as in claim 21 wherein respective ambient conditions associated with some of the detectors are sensed at substantially the same time.

29. An apparatus usable to detect a predetermined condition comprising:

a control unit;

a communications link coupled to said control unit and extending therefrom;

a plurality of spaced apart detectors wherein each member of said plurality is capable of sensing an adjacent ambient condition and of producing an electrical indicium representative thereof, wherein each said member is coupled to said link and is capable of communicating to said ambient condition indicating electrical indicia to said control unit and wherein said control unit includes a storage element for storing at least some of said indicia and circuitry for raising some of said indicia to a first exponential value and raising others to a second, different, exponential value and for summing said exponentially raised indicia to form a result.

30. An apparatus as in claim 29 wherein said control unit squares at least some of said indicia prior to summing.

31. An apparatus as in claim 29 wherein said control unit raises at least some of said electrical indicia to respective exponents which have integer values which exceed two.

32. An apparatus as in claim 29 wherein at least some of said detectors each include a combustion products sensor and wherein said sensor generates an electrical signal indicative of sensed combustion products.

33. An apparatus as in claim 29 wherein said control unit includes a programmable processor.

34. An apparatus as in claim 29 wherein said communications link includes a pair of bi-directional communications lines.

35. An apparatus as in claim 29 wherein said control unit includes a comparator for comparing said result to a predetermined threshold.

36. An apparatus as in claim 29 wherein said control unit includes circuitry for commanding a plurality of said detectors to sense said respective ambient conditions at substantially the same time.

37. An apparatus for detecting a fire condition using a plurality of spaced apart detectors wherein each detector is capable of sensing an ambient condition at substantially the same time and producing an electrical indicium of each sensed condition at that time, the apparatus comprising:

communications circuitry for collecting at least some of the electrical indicia at a common location;

a control unit, coupled to said communications circuitry for processing each electrical indicium by squaring including circuitry for summing the squared indicia to form a result; and a comparator for comparing said result to two or more thresholds to detect respective fire conditions.

38. An apparatus as in claim 37 wherein the detectors detect products of combustion and each detector produces an indicium thereof which can be sampled at a selected time.

39. An apparatus usable to detect an alarm condition comprising:

a control unit;

a communications link coupled to said control unit;

a plurality of spaced apart detectors wherein each member of said plurality is capable of sensing an adjacent ambient condition and of producing an electrical indicium representative thereof, wherein each said member is coupled to said link and is capable of communicating said ambient condition indicating electrical indicia to said control unit, wherein said control unit includes a storage element for storing at least some of said indicia, circuitry for raising at least some of said indicia to predetermined, respective exponents and for summing said exponentially raised indicia to form a result and a comparator for comparing said result to a predetermined threshold and for comparing said stored indicia to a different threshold and wherein said control unit indicates a respective alarm condition if either threshold is exceeded.

40. An apparatus as in claim 39 wherein said control unit raises at least some of said electrical indicia to a first exponent and raises others of said electrical indicia to a second, different exponent.

41. An apparatus as in claim 40 wherein said control unit includes a programmable processor.

42. An apparatus as in claim 41 wherein said communications link includes a pair of bi-directional communications lines.

43. An apparatus as in claim 40 wherein said control unit includes circuitry for commanding a plurality of said detectors to sense said respective ambient conditions at substantially the same time.

* * * * *

UNITED STATES PATENT AND TRADEMARK OFFICE

CERTIFICATE OF CORRECTION

PATENT NO. : 5,483,222

DATED : January 9, 1996

INVENTOR(S) : Tice et al.

It is certified that error appears in the above-indentified patent and that said Letters Patent is hereby corrected as shown below:

Column 3, line 29, change " $\geqq$ " to -- $\geq$ --;

Signed and Sealed this

Fifth Day of November, 1996

*Attest:*

Bruce Lehman

BRUCE LEHMAN

*Attesting Officer*

*Commissioner of Patents and Trademarks*